United States Patent [19]

Irvine

[11] 4,103,803

[45] Aug. 1, 1978

[54] TAMPERPROOF CONTAINER AND CAP ASSEMBLY

[75] Inventor: Ronald T. Irvine, Leominster, Mass.

[73] Assignee: Modern Tool & Die Co., Inc., Leominster, Mass.

[21] Appl. No.: 788,301

[22] Filed: Apr. 18, 1977

[51] Int. Cl.[2] ..... B65D 41/32

[52] U.S. Cl. ..... 220/270; 220/274; 215/256

[58] Field of Search ..... 220/274, 12, 270, 265, 220/266, 306, 85 P, 176; 215/254, 256; 222/182, 541

[56] References Cited

U.S. PATENT DOCUMENTS

| | | | |
|---|---|---|---|
| 3,262,600 | 7/1966 | Gach | 220/284 |
| 3,856,171 | 12/1974 | Rossi | 215/256 |
| 3,913,771 | 10/1975 | Acton et al. | 215/256 |
| 4,037,748 | 7/1977 | Stubbs | 215/256 |

*Primary Examiner*—George T. Hall
*Attorney, Agent, or Firm*—George H. Gerstman

[57] ABSTRACT

A tamperproof container and cap assembly in which the container carries a circumferential radially extending flange which cooperates with the skirt of the cap to prevent the cap from being removed until a portion of the cap skirt is removed. The cap skirt has a circumferential frangible section formed by an internal groove. A pair of spaced lugs are carried by the skirt and a frangible membrane couples the spaced lugs to the frangible section and to each other. The lugs are spaced a sufficient distance to permit the insertion of a tool which may be operated to force the lugs apart thereby breaking the frangible membrane, with one of the lugs forming a pull tab. The pull tab is operative when pulled to cause removal of a portion of the cap skirt, thereby allowing access to the cap for removal.

4 Claims, 7 Drawing Figures

FIG. 6
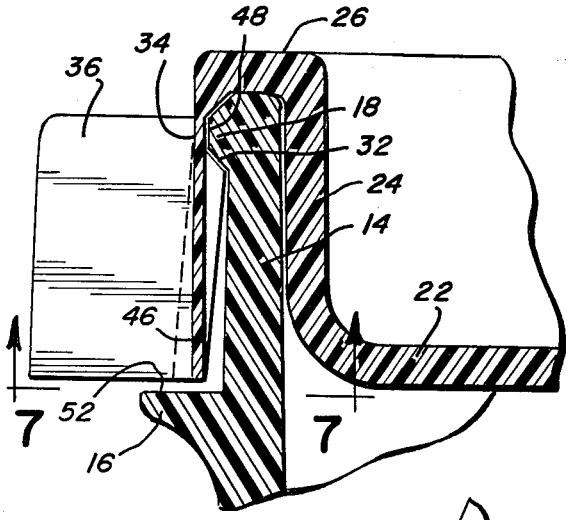
FIG. 5
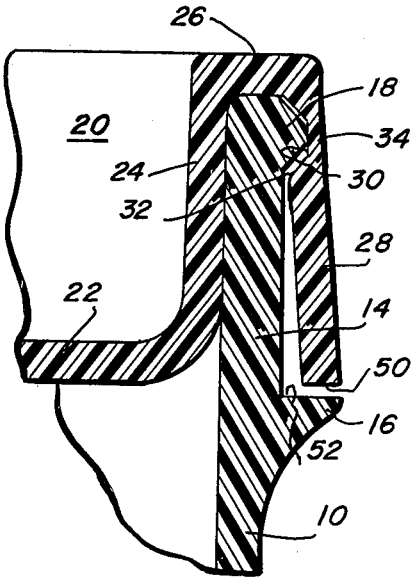
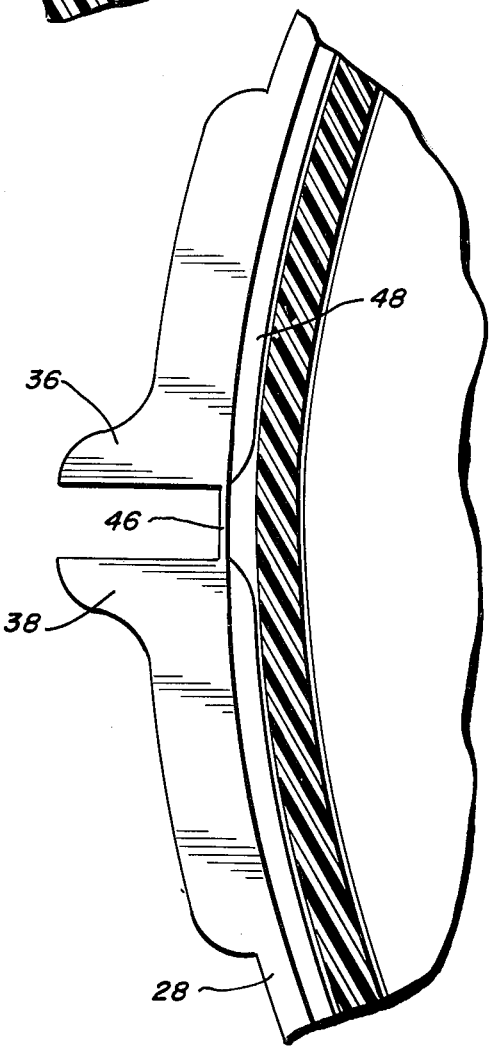
FIG. 7

TAMPERPROOF CONTAINER AND CAP ASSEMBLY

BACKGROUND OF THE INVENTION

This invention concerns a tamperproof container and cap assembly and, more particularly, an assembly in which once the cap and container are assembled, a portion of the cap must be torn away in order for the cap to be readily removed from the container.

Many types of tamperproof container and cap assemblies are in use today. One type of prior art assembly includes a cap having a tear-away portion which, after being torn away, permits simple removal of the cap from the container. An example of such a system is disclosed in Rowe, et al. U.S. Pat. No. 3,831,798. Another example is disclosed in Carvalho U.S. Pat. No. 1,685,227. One of the problems associated with these structures, however, is that it is not difficult to remove the cap from the container without first tearing off the tear strip. This is because access to the most downwardly extending portion of the cap is readily accessible, thereby allowing the cap to be pried up and removed from the container without first tearing the tear strip. As a result, the type of systems disclosed in U.S. Pat. Nos. 3,831,798 and 1,685,227 may not be considered tamperproof systems because there is no positive evidence that the system has been tampered with if the cap is removed without first tearing off the tear strip.

One type of system in which there is positive evidence of tampering is disclosed in Acton, et al. U.S. Pat. No. 3,913,771. In the Acton, et al. system, the container carries a radially extending circumferential flange which cooperates with a tamper indicating band to prohibit access to the cap until the tamper indicating band is removed. One of the disadvantages of the Acton, et al. closure cap, however, is that it is formed in a three-piece construction, requiring complex tooling. Further, for certain applications the Acton, et al. system might be considered unattractive in appearance, in contrast to another type of closure cap which is attractive and might enhance sales.

A container and cap assembly of the type disclosed in Rowe, et al. U.S. Pat. No. 3,831,798 and Carvalho U.S. Pat. No. 1,685,227 is presently in use with respect to plastic orange juice containers. Although this prior art orange juice container and cap assembly is not identical in construction to the systems disclosed in these patents, it has the common disadvantage that the possibility of removing the cap without first tearing off the tear strip exists. In order to obviate this problem, another prior art system, known as the Rigid-Pak system, has been developed for use with respect to plastic orange juice containers. The prior art Rigid-Pak system incorporates a circumferential flange which extends radially from the container and prevents access to the cap for removal until the tear strip is first torn off. The Rigid-Pak closure, like the Acton, et al. closure, enables manual grasping of the tear strip for removal thereof. This enables persons at the point of purchase to remove the tear strip without tools, which in certain instances is undesirable. In addition, the Rigid-Pak closure is completely reclosable because the frangible portion of the cap is located in such a place that removal of the cap will generally not destroy the reclosing ability of the cap. In certain instances, it is desirable that the closure be a one-use closure instead of being continually reclosable.

It is, therefore, an object of the present invention to provide a container and cap assembly in which the cap cannot be pried off the container without first removing a tear strip.

Another object of the present invention is to provide a container and cap assembly in which the container has a circumferential flange extending radially therefrom and cooperating with a tamper indicating tear strip to prevent the cap from being pried off without first removing the tamper indicating tear strip.

A further object of the present invention is to provide a container and cap assembly in which a tool, such as a household implement, is required in order to provide gripping access to the tear strip.

A still further object of the present invention is to provide a container and cap assembly which tends to draw an operator away from reclosing the system once the cap has been removed.

Another object of the present invention is to provide a container and cap assembly which could be used with respect to a plastic orange juice container.

Another object of the present invention is to provide a container and cap assembly which is simple in construction, easy to manufacture and preferably can be produced with simple open and closed type tools, not requiring side actions, cams, collapsible cores, sealoffs (other than those at customary parting lines), or any other secondary mechanical contrivance.

A still further object of the present invention is to provide a container and cap assembly which is attractive in appearance and simple in use.

Other objects and advantages of the present invention will become apparent as the description proceeds.

SUMMARY OF THE INVENTION

In accordance with the present invention, a tamperproof container and cap assembly is provided including a container having a sidewall with a top rim defining an opening. The improvement includes a circumferential flange extending radially from the sidewall.

A cap is provided comprising a top closure surface, an inner wall, a top wall and an outer wall. The inner wall, top wall and outer wall have an inverted U-shape and are located for engagement with the rim. The outer wall has a distal end which is located adjacent the container flange when the cap is in its closed position on the container. The cap and distal end are positioned to prevent access to the cap for removal.

The outer wall of the cap defines a circumferential frangible section having a cross-sectional dimension that is smaller than the cross-sectional dimension of the major portion of the outer wall.

A pair of spaced lugs are carried by the outer wall, and a frangible membrane couples the spaced lugs to the outer wall frangible section. The lugs are spaced a sufficient distance to permit the insertion of a tool which may be operated to force the lugs apart, thereby breaking the frangible membrane. Thus one of the lugs forms a pull tab with the pull tab being operative when pulled to cause removal of the portion of the outer wall between the frangible section and the distal end, thereby allowing access to the cap for removal.

A more detailed explanation of the invention is provided in the following description and claims, and is illustrated in the accompanying drawings.

BRIEF DESCRIPTION OF THE DRAWINGS

FIG. 5 is a fragmentary, enlarged cross-sectional view taken along the plane of the line 5—5 of FIG. 3;

FIG. 6 is a fragmentary enlarged cross-sectional view thereof, taken along the plane of the line 6—6 of FIG. 3; and FIG. 7 is a fragmentary enlarged view of the cap closure lugs, the view being taken upwardly from below FIG. 6.

DETAILED DESCRIPTION OF THE ILLUSTRATIVE EMBODIMENT

Referring to FIGS. 1-4, a plastic orange juice container and cap assembly is shown therein. It is to be understood, however, that the present invention is not limited to plastic orange juice containers.

Figure 1:
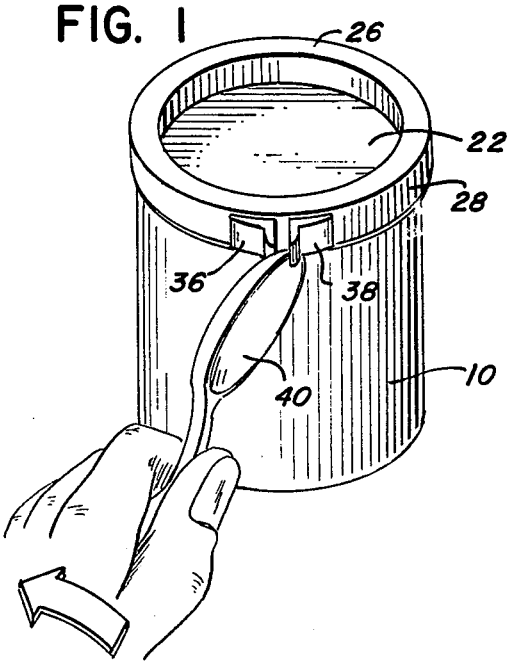
FIG. 1 is a perspective view of a container and cap assembly constructed in accordance with the principles of the present invention, just prior to removal of the tear strip.
Figure 2:
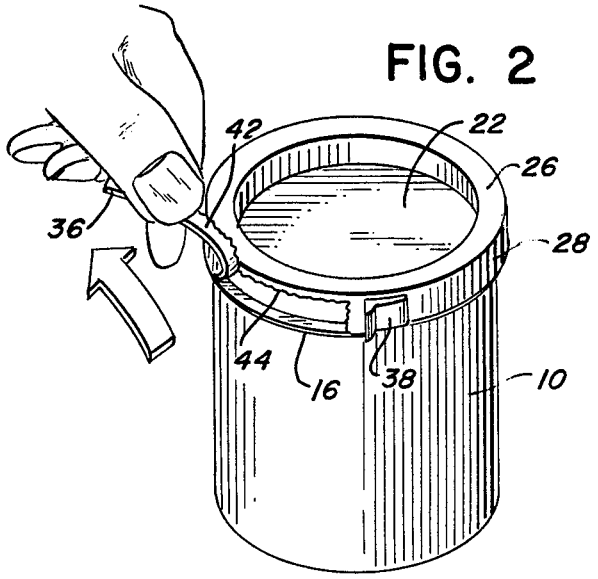
FIG. 2 is a similar view to the view of FIG. 1, except that a portion of the tear strip has been torn from the cap.
Figure 3:
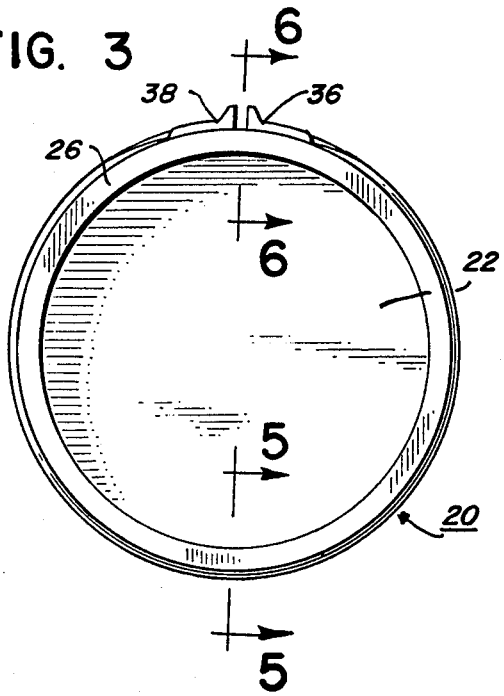
FIG. 3 is a top plan view of a container and cap assembly constructed in accordance with the principles of the present invention.
Figure 4:
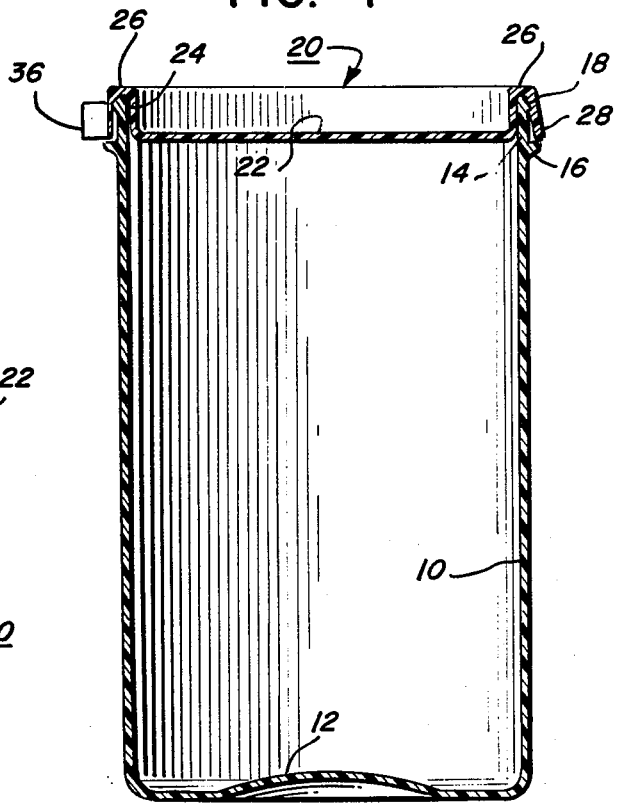
FIG. 4 is a cross-sectional elevation thereof.

The container includes a vertical sidewall portion 10, a dished bottom 12, and an annular rim portion 14 at the top of the sidewall portion 10 and defining a circular opening at the top of the container. As shown in FIGS. 4 and 5, at the junction of sidewall 10 and rim 14 the container carries a circumferential radially extending flange 16 and at the top of rim 14 there is a radially extending cap-engaging circumferential bead 18.

As shown most clearly in FIGS. 4 and 5, the cap 20 includes a top closure portion 22, an annular inner wall 24, an annular top wall 26 and a circumferential outer wall (or skirt) 28. Inner wall 24, top wall 26 and outer wall 28 have an inverted U-shape configuration and the external diameter of the inner wall 24 is such that it forms a plug fit with the internal diameter of the container. If desired, inner wall 24 could take the form of an annular rib which projects downwardly from a lid.

The interior of outer wall 28 defines a circumferential groove 30 which forms a shoulder 32 for cooperation with annular bead 18. When cap 20 is in its closed position upon the container, as shown in FIG. 5 shoulder 32 underlies the bottom portion of bead 18 thereby enhancing the connection of the cap to the container. Groove 30 also acts to define a frangible section 34 which extends the entire circumference of the outer wall and has a cross-sectional dimension that is far less than the cross-sectional dimension of the major portion of the outer wall. As a specific example, although no limitation is intended, frangible section 34 is 0.005 inch in thickness.

A pair of lugs 36, 38 are formed integrally with cap 20, which is preferably a unitary, one-piece integrally formed plastic molded unit. Lugs 36, 38 each have a radially extending portion which is spaced from the other (as shown most clearly in FIGS. 1-3), to enable a tool, such as a spoon 40, to be inserted between the spaced lugs and twisted, thereby breaking the membrane and providing a tear strip 42 (FIG. 2) which is torn off by the operator. The severance line 44 is the frangible section 34 which is broken as the tear strip 42 is pulled circumferentially around the container.

As shown most clearly in FIGS. 6 and 7, a membrane 46 connects lugs 36 and 38 to frangible section 34 and to each other. Membrane 46 preferably has the same thickness as frangible section 34 which, in a specific example (although no limitation is intended), is 0.005 inch. Referring to FIGS. 6 and 7, it can be seen that an undercut 48 is defined at the area at which lugs 36, 38 are formed, in order to enable the tearing of tear strip 42 to commence once membrane 46 is severed.

Referring to FIG. 5, it can be seen that once the portion of outer wall 28 below frangible section 34 is removed, shoulder 32 will no longer be present to provide the same secure closure engagement as previously. In this manner, the system is preferably not to be used as a reclosable assembly. Further, it can be seen that the lugs 36, 38 are dimensioned so that an operator cannot begin the tearing operation of the tear strip 42 without first inserting an implement between the lugs. In this manner, persons at the point of purchase will not be attracted to remove the tear strip. Since two separate lugs are used, the tearing of the strip can easily be accomplished by right and left-handed persons, in a conventional manner.

It can further be seen that once the tear strip 42 is removed, a major portion of the outer wall of the cap has been removed, thereby readily evidencing tampering. Until tear strip 42 is removed, when the cap is in its closed position on the container, the distal end 50 of outer wall 28 is so close to the top 52 of circumferential flange 16 that access to the cap for removal without first removing tear strip 42 is prevented.

Although an illustrative embodiment of the invention has been shown and described, it is to be understood that various modifications and substitutions may be made by those skilled in the art without departing from the novel spirit and scope of the present invention.

What is claimed is:

1. A tamperproof container and cap assembly including a container having a sidewall with a top rim defining an opening, the improvement comprising: a peripheral flange extending radially from the sidewall; a cap comprising a top closure surface, an inner wall, a top wall and an outer wall, said inner wall, top wall and outer wall having an inverted U-shape and being located for engagement with said rim; said outer wall having a distal end which vertically overlies and is located adjacent said container flange when the cap is in its closed position on the container, with the cap and distal end being positioned to prevent access to the cap for removal; said outer wall defining a frangible section having a cross-sectional dimension that is smaller than the cross-sectional dimension of the major portion of said outer wall, a peripheral cap-engaging bead extending radially from said container rim above said peripheral flange; said outer wall defining an internal shoulder for cooperation with said cap-engaging bead and being located intermediate said frangible section and said distal end; said frangible section being located for positioning adjacent said cap-engaging bead when the cap is in its closed position on the container; a pair of spaced lugs carried by said outer wall, a frangible membrane coupling said spaced lugs to said outer wall frangible section, said lugs being spaced a sufficient distance to permit the insertion of a tool which may be operated to force said lugs apart thereby breaking said frangible membrane, with one of said lugs forming a pull tab, said pull tab being operative when pulled to cause removal of the portion of the outer wall between the frangible section and the distal end, thereby allowing access to the cap for removal.

2. A tamperproof container and cap assembly as described in claim 1, said frangible membrane coupling said spaced lugs to each other, with said cap comprising a one-piece integrally formed molded unit.

3. A tamperproof container and cap assembly including a plastic container having a sidewall with a top rim defining an opening, and a cap-engaging bead extending radially from said rim, the improvement comprising: said container carrying a peripheral flange which extends radially from the sidewall in a plane below said bead; a cap comprising a top closure surface, an inner wall, a top wall and an outer wall, said inner wall, top wall and outer wall having an inverted U-shape and being located for engagement with said rim; said inner wall dimensioned to cooperate with said rim with a plug fit; said outer wall having a distal end which vertically overlies and is located adjacent said container flange when the cap is in its closed position on the container, with the flange and the distal end being positioned to prevent access to the cap for removal; said outer wall defining an internal frangible section located adjacent said bead when the cap is in its closed position on the container, said outer wall defining an internal shoulder for cooperation with said cap-engaging bead and being located intermediate said frangible section and said distal end, said frangible section having a cross-sectional dimension that is smaller than the cross-sectional dimension of the major portion of said outer wall; a pair of spaced lugs carried by said outer wall, a frangible membrane coupling said spaced lugs to said outer wall frangible section, said lugs being spaced a sufficient distance to permit the insertion of a tool which may be operated to force said lugs apart thereby breaking said frangible membrane, with one of said lugs forming a pull tab, said pull tab being operative when pulled to cause removal of the portion of the outer wall between the frangible section and the distal end, thereby allowing access to the cap for removal.

4. A tamperproof container and cap assembly as described in claim 5, said frangible membrane coupling said spaced lugs to each other, with said cap comprising a one-piece integrally formed molded unit.

* * * * *